US009572209B2

(12) United States Patent
Hu et al.

(10) Patent No.: US 9,572,209 B2
(45) Date of Patent: Feb. 14, 2017

(54) LED ACTUATING DEVICE AND METHOD

(71) Applicant: Jun Hu, Guangdong (CN)

(72) Inventors: Jun Hu, Guangdong (CN); Yongming Deng, Guangdong (CN); Ping Liu, Guangdong (CN)

(73) Assignee: Jun Hu (CN)

( * ) Notice: Subject to any disclaimer, the term of this patent is extended or adjusted under 35 U.S.C. 154(b) by 0 days.

(21) Appl. No.: 14/529,255

(22) Filed: Oct. 31, 2014

(65) Prior Publication Data

US 2015/0123574 A1 May 7, 2015

(30) Foreign Application Priority Data

Nov. 3, 2013 (CN) ..... 2013 1 0548029

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 33/08*** | (2006.01) |

(52) U.S. Cl.

CPC ..... *H05B 33/0815* (2013.01); *H05B 33/0851* (2013.01)

(58) Field of Classification Search

USPC ..... 315/309

See application file for complete search history.

(56) References Cited

U.S. PATENT DOCUMENTS

| | | | | |
|---|---|---|---|---|
| 7,635,957 | B2 * | 12/2009 | Tripathi et al. | 315/309 |
| 8,310,171 | B2 * | 11/2012 | Reisenauer et al. | 315/287 |
| 2007/0200513 | A1 * | 8/2007 | Ha et al. | 315/309 |
| 2012/0105228 | A1 * | 5/2012 | Loveland et al. | 340/540 |

* cited by examiner

*Primary Examiner* — Anh Tran

(57) ABSTRACT

An actuating device comprises an LED actuating module. Said LED actuating module comprises a micro-programmed control unit (MCU), an actuator, a VF-value detection module, a PN-junction temperature acquisition module and an LED lamp unit. The MCU determines the current value matched with the LED lamp unit based on the VF value detected by the VF-value detection module and the temperature value detected by the PN-junction temperature acquisition module, and then determines the width of the PWM pulse output to the actuator according to the current value, and the actuator actuates an LED to operate at the matched current value.

10 Claims, 5 Drawing Sheets

| LED forward direction voltage VF (mV) | Performance database current value (mA) |
|---|---|
| 3300 | 350 |
| 3290 | 344. 4 |
| 3280 | 338. 8896 |
| 3270 | 333. 4673664 |
| 3260 | 328. 1318885 |
| 3250 | 322. 8817783 |
| 3240 | 317. 7156699 |
| 3230 | 312. 6322191 |
| 3220 | 307. 6301036 |
| 3210 | 302. 708022 |
| 3200 | 297. 8646936 |
| 3190 | 293. 0988585 |
| 3180 | 288. 4092768 |
| 3170 | 283. 7947284 |
| 3160 | 279. 2540127 |
| 3150 | 274. 7859485 |
| 3140 | 270. 3893733 |
| 3130 | 266. 0631434 |
| 3120 | 261. 8061331 |
| 3110 | 257. 6172349 |
| 3100 | 253. 4953592 |
| 3090 | 249. 4394334 |
| 3080 | 245. 4484025 |
| 3070 | 241. 5212281 |
| 3060 | 237. 6568884 |
| 3050 | 233. 8543782 |
| 3040 | 230. 1127081 |
| 3030 | 220. 1127081 |
| 3020 | 210. 1127081 |
| 3010 | 200. 1127081 |
| 3000 | 190. 1127081 |

Fig. 3

| Temperature (℃) | Performance database current value (mA) |
|---|---|
| 25 | 350 |
| 26 | 347. 2 |
| 27 | 344. 4224 |
| 28 | 341. 6670208 |
| 29 | 338. 9336846 |
| 30 | 336. 2222152 |
| 31 | 333. 5324374 |
| 32 | 330. 8641779 |
| 33 | 328. 2172645 |
| 34 | 325. 5915264 |
| 35 | 322. 9867942 |
| 36 | 320. 4028998 |
| 37 | 317. 8396766 |
| 38 | 315. 2969592 |
| 39 | 312. 7745835 |
| 40 | 310. 2723869 |
| 41 | 307. 7902078 |
| 42 | 305. 3278861 |
| 43 | 302. 885263 |
| 44 | 300. 4621809 |
| 45 | 298. 0584835 |
| 46 | 295. 6740156 |
| 47 | 293. 3086235 |
| 48 | 290. 9621545 |
| 49 | 288. 6344573 |
| 50 | 286. 3253816 |
| 51 | 284. 0347786 |
| 52 | 281. 7625003 |
| 53 | 279. 5084003 |
| 54 | 277. 2723331 |
| 55 | 275. 0541545 |
| 56 | 272. 8537212 |
| 57 | 270. 6708914 |
| 58 | 268. 5055243 |
| 59 | 266. 3574801 |
| 60 | 264. 2266203 |
| 61 | 262. 1128073 |
| 62 | 260. 0159049 |
| 63 | 257. 9357776 |
| 64 | 255. 8722914 |
| 65 | 253. 8253131 |
| 66 | 251. 7947106 |
| 67 | 249. 7803529 |
| 68 | 247. 7821101 |
| 69 | 245. 7998532 |
| 70 | 243. 8334544 |
| 71 | 241. 8827867 |
| 72 | 239. 9477244 |
| 73 | 238. 0281426 |
| 74 | 236. 1239175 |
| 75 | 234. 2349261 |
| 76 | 232. 3610467 |
| 77 | 230. 5021584 |
| 78 | 228. 6581411 |
| 79 | 226. 828876 |
| 80 | 225. 014245 |
| 81 | 223. 214131 |
| 82 | 221. 428418 |
| 83 | 219. 6569906 |
| 84 | 217. 8997347 |
| 85 | 216. 1565368 |

Fig. 4

LED ACTUATING DEVICE AND METHOD

FIELD OF THE INVENTION

The invention relates to illumination, and particularly relates to an LED actuating device and method.

BACKGROUND OF THE INVENTION

An LED semiconductor luminescent device comprises a semiconductor light-emitting diode (LED), a nixie tube, a symbol tube, a *-shaped tube and a dot matrix display screen (hereinafter referred to as a "matrix tube") and the like. In fact, each light-emitting unit in the nixie tube, the symbol tube, the *-shaped tube and the matrix tube is a light-emitting diode.

The performance of an LED is determined by parameters of the LED and some key parameters relevant to an LED are as follows: (1) allowable power dissipation Pm, which refers to the maximum value of the product of the forward DC voltage allowed to be applied on both ends of the LED and the passing-through current. If the value is exceeded, the LED becomes hot and can be damaged. (2) Maximum forward DC current IFm, which refers to the allowable maximum forward DC current. If the value is exceeded, diodes can be damaged. (3) Inverse peak voltage VRm, which refers to the allowable inverse peak voltage. If the value is exceeded, the light-emitting diode can be broken down and damaged. (4) Operating temperature topm, which refers to the range of the environment temperature for normal operation of light-emitting diodes, and if the temperature of the operating environment is beyond the temperature range, the light-emitting diodes cannot operate properly and the efficiency is greatly reduced. (5) Forward operating current If, which refers to the forward current value when the light-emitting diode emits light normally. In actual use, the IF should be selected below 0.6·IFm as required. (6) Forward operating voltage VF, and the operating voltage given in the parameter list is achieved with the given forward current and usually measured when IF=20 mA. The light-emitting diode has the forward operating voltage VF within 1.4~3V. When the external temperature rises, the VF decreases. (7) V-I characteristics, wherein the relationship between voltage and current of a light-emitting diode is that when the forward voltage is just below a given value (called a threshold value), the current becomes extremely low and the LED cannot be lighted up. When the voltage exceeds the value, the forward current rises rapidly and progressively along with the voltage and the LED is lighted up.

Currently, at home and abroad, the LED is activated by means of constant voltage or constant current. No matter under numerical control or simulation control, when a constant-current and constant-voltage LED actuating power supply is equipped to actuate the LED lamp unit, the constant-voltage or constant-current control technology is adopted during operation no matter how great the VF value of the LED lamp unit is changed, that is, the output voltage and current coincide with the rated values of the lamp unit; however, the VF-values of LED lamp units are different from those of different manufacturers, especially the VF-value consistency is much poorer for the LED lamp units from those of the factories with a less advanced packaging technology. And after lamp beads completely different in the VF-value consistency constitute a lamp unit, the VF-values quickly drift and decrease under the impact of the temperature, but the existing LED power supplies all have constant voltage or constant current, so it is completely impossible to adjust the output current and voltage according to the serious drift of the VF-value when the LED lamp unit is exposed to a high temperature, thus forcing the LED lamp unit to operate under the condition of low VF voltage and constant current. As a result, the PN-junction temperature of the LED continues to rise to speed up light depreciation, aging and color temperature deviation of the LED lamp unit.

For example, in time of constant-current actuation, when the output voltage and current of an LED actuating power supply is 36V and 2.4 A respectively, the output power should be 86 W; when the temperature rises and the VF-value deceases, the output voltage has tiny changes: 30V, and the output power is 72 W. The LED lamp unit's temperature continues rising to cause continuous VF-value falling due to the 2.4 A constant-current actuation, while the actual luminous flux of the LED lamp unit is greatly reduced due to lowering of the VF-value, thus speeding up light depreciation, flickering and color temperature deviation of the LED lamp beads when a constant current passes through. In time of constant-voltage actuation, when the output voltage and current of the LED actuating power supply are is 36V and 2.4 A respectively, the output power should be 86 W; when the temperature rises and the VF-value decreases, the output voltage is always adjusted to be 36V via the feedback regulation function of the constant-voltage actuator, while the output current rises to 2.6 A instead, and the output power also rises to be 93.6 W. The continuous rising of the PN-junction temperature of the LED lamp unit results in continuous decreasing of the VF-value, the current further rises because of the feedback regulation function of the constant-voltage circuit, with the consequence that the power continuously kept out of limits, which results in burning of the LED lamp unit.

SUMMARY OF THE INVENTION

In view of the existing problems in the prior art, the invention provides an LED actuating device and method.

Technical solution 1: an LED actuating method, comprising the following steps:

detecting the forward operating voltage value and PN-junction temperature of an LED lamp unit;

determining the current value matched with the LED lamp unit according to the detected forward operating voltage value and the PN-junction temperature;

determining the PWM duty ratio according to the matched current value; and actuating the LED lamp unit to operate at the matched current value by means of the PWM duty ratio.

Technical solution 2: the method as claimed in technical solution 1, comprising the following steps: setting up a performance data proofreading base of forward operating voltage values, searching the current value corresponding to the detected forward operating voltage value in the performance data proofreading base of forward operating voltage values as the current value matched with the LED lamp unit. wherein matched current values of the LED lamp units corresponding to different forward operating voltage values are stored in the performance data proofreading base.

Technical solution 3: the method as claimed in technical solution 1, comprising the following step: when no current value corresponding to the detected forward operating voltage value in the performance data proofreading base of the forward operating voltage value, calculating the average value of the current values corresponding to the two forward operating voltage values adjacent to the detected forward operating voltage values in the performance data proofreading base as the current value corresponding to this detected forward operating voltage value, wherein the detected forward operating voltage value is between the two adjacent forward operating voltage values.

Technical solution 4: the method as claimed in technical solution 1, comprising the following steps: setting up a temperature value performance data proofreading base, and searching the current value corresponding to the detected temperature value in the temperature value performance data proofreading base as the current value matched with the LED lamp unit, wherein the matched current values of the LED lamp units corresponding to different temperature values are stored in the performance data proofreading base of the temperature values.

Technical solution 5: the method as claimed in technical Solution 4, comprising the following step: when no current value corresponding to the detected temperature value is searched in the temperature value performance data proofreading base, calculating the average value of the current values corresponding to the two temperature values adjacent to the detected temperature values in the temperature value performance data proofreading base as the current value corresponding to the detected temperature value, wherein the detected temperature value is between the two adjacent temperature values.

Technical solution 6: the method as claimed in technical solution 1, comprising the following steps: lightning and surge protection filtering, EMI filtering, bridge rectifying and power factor correction.

Technical solution 7: the method as claimed in technical solution 1, comprising the following step: stopping driving the LED lamp unit when the detected PN-junction temperature exceeds the operating temperature (topm).

Technical solution 8: the method as claimed in technical solution 1, comprising the following steps: sending the PWM pulse to the LLC resonant half-bridge actuator through an opto-coupler, actuating the half-bridge circuit (composed of two MOS tubes) to be on/off by the LLC resonant half-bridge actuator, then outputting the half-bridge circuit output to the schottky diode rectifier circuit by the isolation transformer, and finally outputting a stable DC current to supply the LED lamp unit by the schottky diode rectifier circuit.

Technical solution 9: the method as claimed in technical solution 1, comprising the following steps: acquiring the current value passing through the LED lamp unit, and adjusting the PWM pulse width based on the difference between the acquired current value and the matched current value. The LED actuating device, which comprises an LED actuating module, wherein the LED actuating module comprises a micro-programmed control unit, an actuator, a VF-value detection module, a PN-junction temperature acquisition module and an LED lamp unit; the MCU determines the current value matched with the LED lamp unit based on the VF value detected by the VF-value detection module and the temperature value detected by the PN-junction temperature acquisition module and determines the width of the PWM pulse output to the actuator according to the current value, so that the actuator can actuate the LED lamp unit to operate at the matched current value.

The invention has the beneficial effects as follows: according to the operating characteristics of the LED lamp unit, the invention detects the temperature value and VF-value of the LED lamp unit to adjust the actuating current of the LED lamp unit from time to time, so that the LED lamp cannot operate at the initial rated current when the VF-value drops, thus reducing the overall temperature of the lamp unit, and the PN-junction temperature of the LED lamp unit and meanwhile prolonging the service life of the LED lamp unit and saving the energy.

BRIEF DESCRIPTION OF THE DRAWINGS

FIG. 3 is the performance data proofreading base of the VF-values;

FIG. 4 is the performance data proofreading base of the temperature values.

DETAILED DESCRIPTION OF THE PREFERRED EMBODIMENTS

The technical solutions in the embodiments of the invention are described clearly and completely in conjunction with the figures attached in the embodiments, and obviously, the described embodiments are only part of, rather than all of embodiments in the invention. Based on the embodiments in the invention, all other embodiments obtained at the premise of no creativity made by a person skilled in the part are all within the protection scope of the invention.

The invention can be used for detecting the VF-value of the LED lamp unit dynamically, then the corresponding actuating current is matched with the LED lamp unit according to the decrease of the luminous flux resulting from the VF-value changes, further the LED actuating current is adjusted dynamically to save energy and prolong the service life of the LED lamp unit. The invention is described in details further by virtue of the figures attached.

Figure 1:
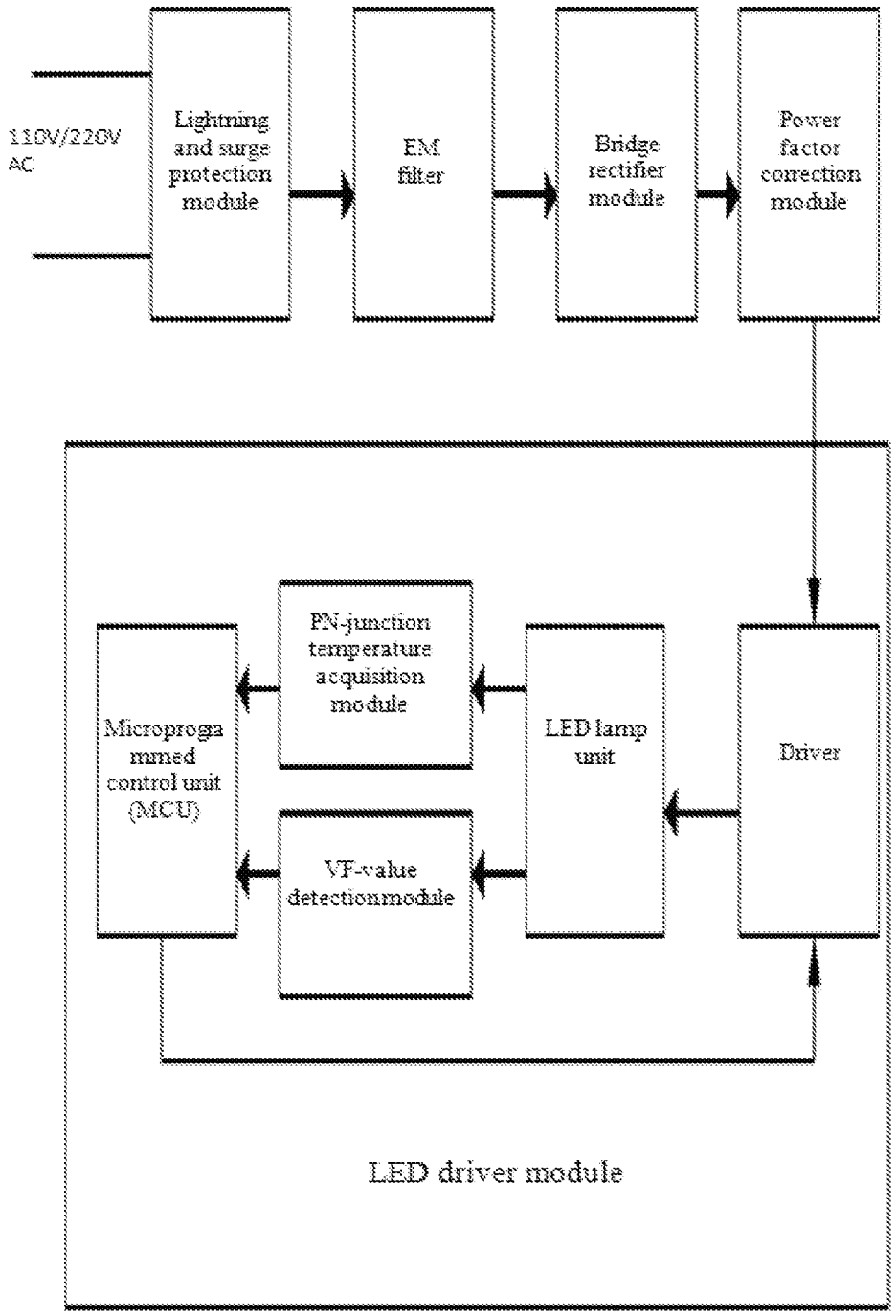
FIG. 1 is the schematic diagram of the LED lamp unit actuating device.

FIG. 1 is a schematic diagram of the embodiment of the LED lamp unit actuating device provided by the invention, and in the embodiment, the LED lamp unit actuating device comprises a lightning and surge protection module, an EMC EMI filter module, a bridge rectifier module, a power-factor correction module (APFC) and an LED actuating module.

Wherein, the lightning and surge protection module is used for eliminating the impact of lightning stroke or surge voltage; the EMI filter is used for preventing the high-frequency interference generated by the actuator from being transmitted back to the power line, the full-bridge rectifier is used for converting AC power into DC power, and the APFC is used for controlling the waveform of the AC input current to follow the waveform of the voltage so as to improve the power factor to be higher than 0.99, and also can be used for regulating different pulse widths according to different output currents to reduce the power grid harmonic waves and to produce an adjustable DC bus voltage to be output to the LED actuating module.

The LED actuating module comprises a micro-programmed control unit (MCU), an LLC resonant half-bridge actuator, a VF-value detection module used for detecting the forward operating voltage value, a PN-junction temperature acquisition module and an LED lamp unit.

The PN-junction temperature acquisition module acquires the PN-junction temperature and transmits the acquired temperature signal to the controller; the LLC resonant half-bridge driver is used for adjusting the output current of the LED lamp unit based on the actual current value matched with the single-chip computer; the VF-value detection module is used for detecting the VF-value of the LED lamp unit and transmitting the detected VF-value to the controller; the actuating device provided by the invention improves the efficiency of the actuating device by an LLC resonant topology structure. The preceding stage of the actuating circuit achieves AC/DC conversion and APFC functions by a booster (Boost) topology in the critical current mode (BCM), the latter stage builds up a DC/DC preset constant current source by an LLC resonant half-bridge topology. In conclusion, the two-stage structure can make full use of the high-efficient characteristics of the Boost and LLC resonant.

The MCU is used for controlling the operation of the LED lamp unit, adjusting the current of the LED lamp unit based on the detected PN-junction temperature signal and VF-value, and moreover detecting short circuit, overcurrent, overvoltage and other relevant parameters so as to protect the LED actuating module. For example, when the PN-junction temperature value acquired by the PN-junction temperature acquisition module exceeds the operating temperature (topm), then the MCU will stop actuating the LED lamp unit. The MCU provided by the invention comprises microprocessors, such as a single chip microcomputer, DSP and memory modules, which can be used for storing the necessary programs and the performance data proofreading base as mentioned below; moreover, the MCU also comprises A/D converters, PWM output modules and communication interfaces, etc.

Figure 2:
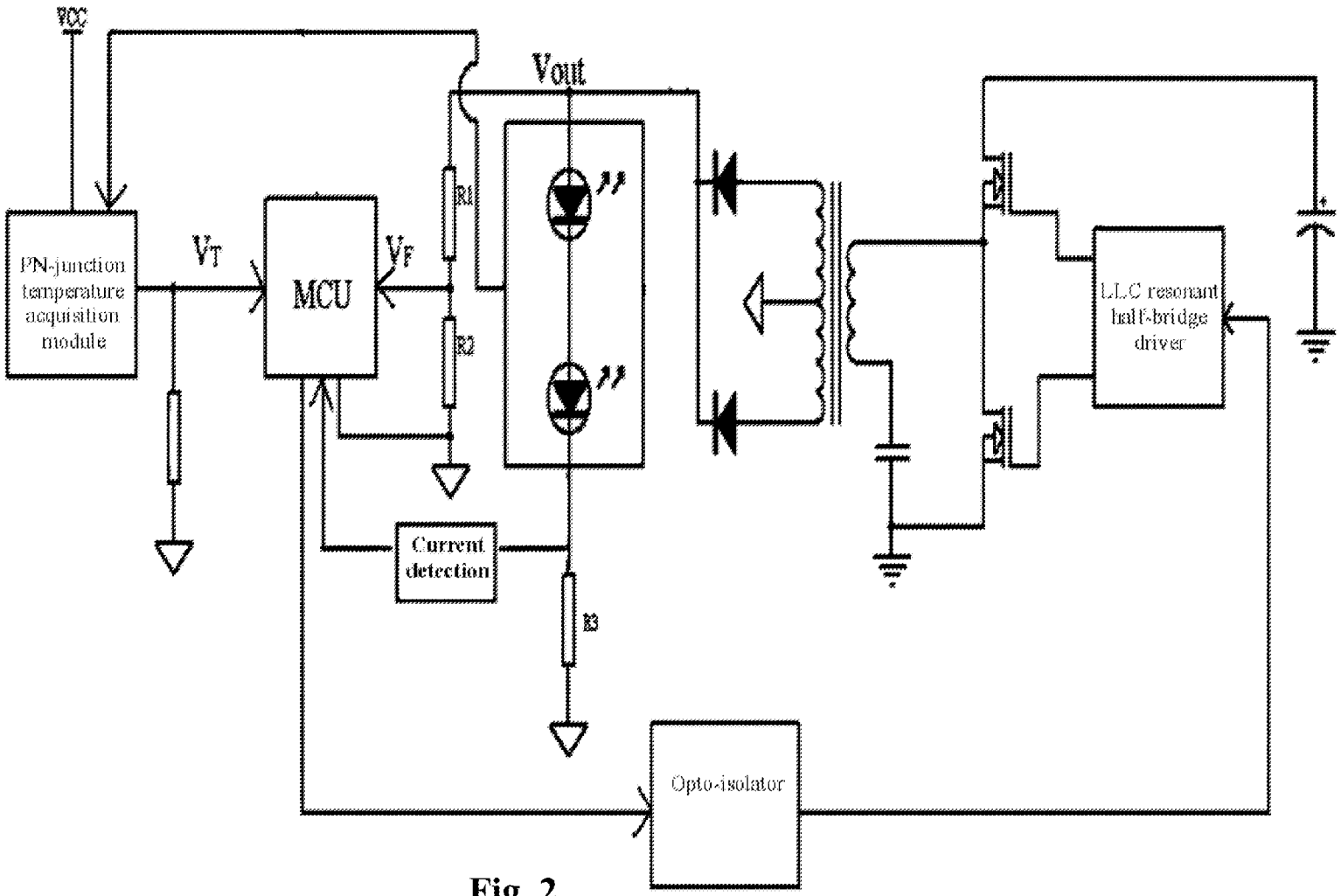
FIG. 2 is the schematic diagram of the LED driver module.

FIG. 2 is a detailed execution mode of the LED actuating module. As shown in FIG. 2, the PN-junction temperature acquisition module converts the acquired temperature signal into voltage signal VT and transmits to the MCU; the MCU can judge the environmental temperature before the LED lamp unit starts to operate. At the same time, the module can dynamically detect the PN-junction temperature after the lamp unit operates for a period of time and transmit the collected PN-junction temperature data to the MCU; the MCU forms an LED unit output voltage bleeder circuit through the resistors R1 and R2 to acquire the VF voltage value of the LED lamp unit. Simultaneously MCU compares the acquired temperature value and VF-value with the default parameters previously stored in the performance database of the MCU (for example, the performance data proofreading base for the forward operating voltage to be described in detail below, namely the performance data proofreading base of the VF-values) to obtain the actuating current matched with the LED lamp unit. Then, the MCU calculates the PWM duty ratio to be output based on the obtained actuating current value, and then outputs the PWM pulse corresponding to the duty ratio to the actuating half-bridge circuit through an opto-isolator so as to adjust the current of the LED lamp unit; when the current of the LED lamp unit is required to be adjusted to rise, the PWM pulse width of the MCU is widened and sent to the grid electrodes of the two MOS tubes in the half-bridge circuit by an opto-coupler and then output through an isolation transformer, secondary windings of the isolation transformer outputs a stable DC current to supply the LED lamp unit and thus increase the operating current of the LED lamp unit after rectification through two schottky diodes; and when the current of the LED lamp unit is needed to be lower, the PWM pulse width of the MCU becomes narrower, thereby reducing the running current of the LED lamp unit; in the way, the running current of the LED lamp unit can be kept constant dynamically. The LED actuating module also comprises a current detection module connected between the resistor R3 and the controller to detect the current value passing through the LED lamp unit. The detected current value is compared with the corresponding current value in the performance database. And it is able to adjust the PWM pulse width according to the difference between the two values to constitute closed-loop control, so that the actuating current could be more precisely adjusted. Certainly, the invention is not limited to particular half-bridge circuits, half-bridge circuit actuators or particular rectifier circuits.

An introduction on how the MCU can get the actuating current matched with the LED lamp unit is made. The MCU adjusts the current value of the LED lamp unit based on the VF changes, determines the operating current of the LED lamp unit by detecting the VF-value of the LED lamp unit, and simultaneously changes the PWM pulse width of the LLC resonant half-bridge actuator to output the dynamic current. The MCU matches the LED lamp unit with the corresponding actuating current value in the performance data proofreading base of the default VF-values according to the detected VF-value. The different VF-values and the actuating current of the LED lamp units corresponding to different VF-values are stored in the performance data proofreading base of the VF-values, and the data in the performance data proofreading base of the default VF-values can be available from sampling according to the characteristics of the LED lamp unit. An introduction of the performance data proofreading base of the VF-values is made further.

As shown in FIG. 3, an actual performance data proofreading base of the VF-value is set up in the invention for determining the actuating current value matched with the LED lamp unit according to the detected VF-values. The particular set procedures are as follows: a VF-value performance database is set up based on the LED application environment, that is, supposing the luminous flux is not changed obviously with the lower and upper limits of the control precision kept at 0.005V and 0.01V respectively, each time when the voltage of the VF-value of LED lamp unit drops by 0.01 V if the VF-value changes, the current value is adjusted according to the expected brightness/luminous flux of the LED lamp unit, then the current value is recorded when the desired brightness/luminous flux has been achieved, and then the current value is the actuating current value corresponding to the VF voltage, so that the actuating current value is matched with the actual luminous flux/brightness corresponding to the LED lamp unit, and the current value is stored in the default performance database, a performance data proofreading base of the VF-values as shown in FIG. 3 can be obtained.

When the detected signal of the VF-value does not exist in the performance database, then the average value of the current values corresponding to the two VF-values adjacent to the VF signal is calculated to act as the current value corresponding to the VF signal, wherein the detected VF signal is between the two VF-values. For example, if the detected VF is 3263 mV, then the average value of the two current values corresponding to 3260 mV and 3270 mV in the performance database as the current value of 3263 mV.

The VF-value is always 0 before the lamp is turned on, but the ambient temperature/PN-junction temperature of the LED are different, for example, factors such as different seasons, different LED surroundings and time duration from the point when the LED was turned on last time, can exert impact on the PN-junction temperature before the LED lamp unit starts to operate. In order to determine the current value matched with the LED lamp unit before the LED lamp unit starts to operate, the PN-junction temperature acquisition module collects the PN-junction temperature and transmits the collected temperature signal to the MCU, and the MCU matches the LED lamp unit with the corresponding actuating current value in the temperature performance data proofreading base according to the detected temperature value. Different temperature values of the LED lamp unit and the actuating current of the LED lamp unit corresponding to the temperature value are stored in the temperature performance data proofreading base, and the data in the temperature performance data proofreading base can be available from sampling according to the characteristics of the LED lamp unit. The temperature performance data proofreading base is introduced further.

As shown in FIG. 4, the temperature performance data proofreading base set up in the invention is used for determining the actuating current value matched with the LED lamp unit according to the detected temperature values. The particular set procedures are as follows: a temperature performance database is set up based on the actual LED application environment. Supposing the luminous flux is not changed obviously with the lower and upper limits of the control precision kept at 0.5 and 2.0 degrees respectively, each time when the temperature value of the LED lamp unit rises by 1.0 degree if the temperature value changes, the current value is adjusted according to the expected brightness/luminous flux of the LED lamp unit, and then the current value is recorded when the desired brightness/luminous flux is achieved, the current value is the actuating current value corresponding to the temperature, so that the actuating current value is matched with the actual luminous flux/brightness corresponding to the LED lamp unit, and if the value is stored in the default performance database, a performance database as shown in FIG. 4 can be obtained.

When the detected temperature signal does not exist in the performance database, then the average value of the current values corresponding to the two temperature values adjacent to the temperature signal is calculated as the current value corresponding to the temperature signal, wherein the detected temperature signal is between the two temperature values. For example, if the detected temperature is 30.6 degree, then the average value of the two current values corresponding to 30 degree –31 degree in the performance database is calculated as the current value of 30.6 degree.

In this way, the MCU determines the actuating current matched with the LED lamp unit according to the VF-value performance data proofreading base and the temperature performance data proofreading base. the MCU always actuates the LED by the current value matched with the LED, and when the VF-value of the LED lamp unit decreases, a precise voltage sensor is actuated to input the detected VF voltage (amplified through an amplifier) of the LED lamp unit to the A/D input terminal of the MCU, and the MCU controls the output current size of the LLC resonant half-bridge actuator according to the detected VF voltage value.

Figure 5:
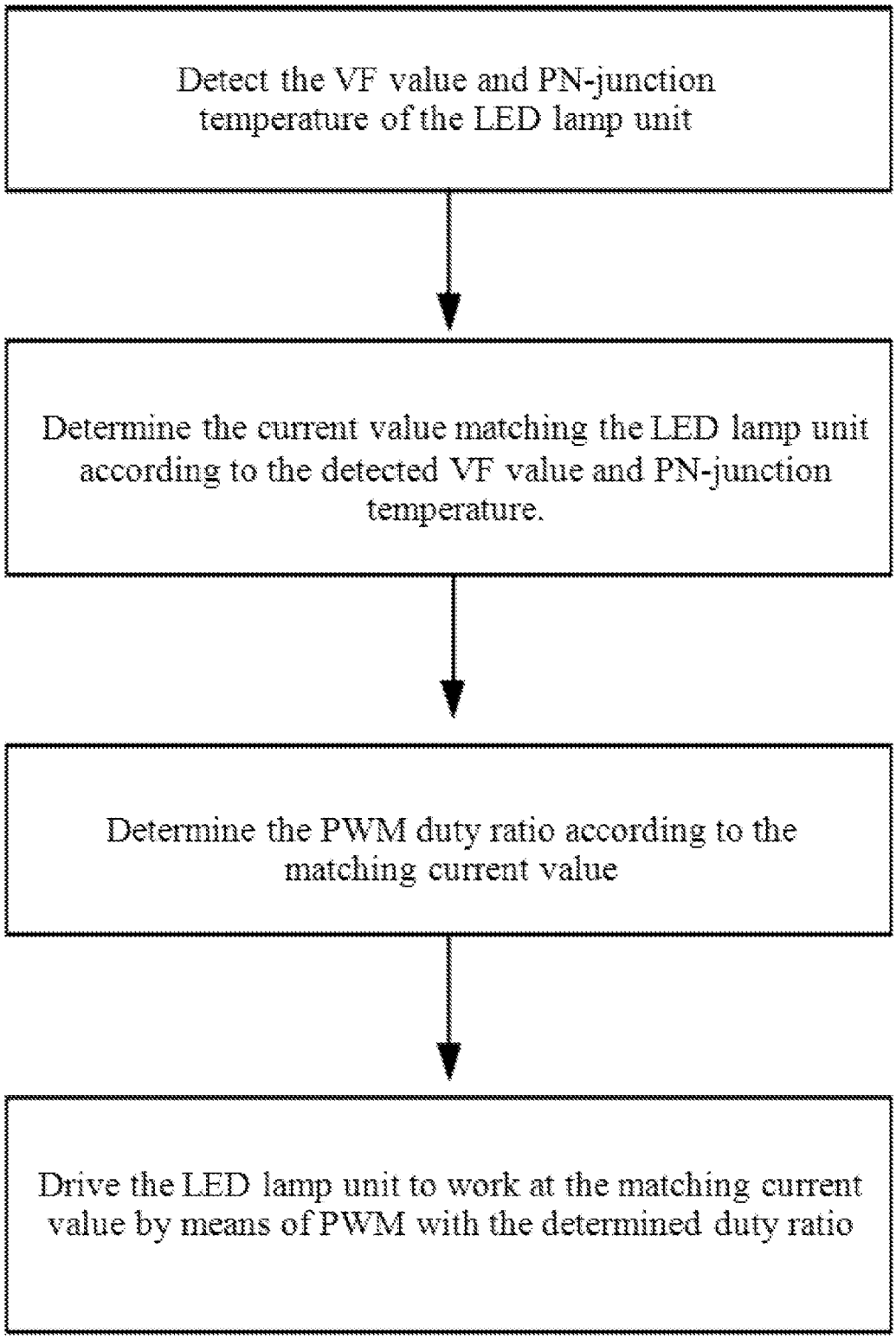
FIG. 5 is the flow chart for the LED actuating method.

As shown in FIG. 5, the invention also provides an LED driving method, comprising the following steps: detecting the VF-value and PN-junction temperature of the LED lamp unit; determining the current value matched with the LED lamp unit according to the detected VF-value and PN-junction temperature; determining the PWM duty ratio according to the matched current value; and actuating the LED lamp unit to operate at the matched current value by the PWM with the duty ratio.

Wherein, when the detected VF-value and PN-junction temperature are used for determining the current value matched with the LED lamp unit, firstly, setting up a VF-value performance data proofreading base and then searching the current value corresponding to the detected VF-value in the VF-value performance data proofreading base as the current value matched with the LED lamp unit, wherein the matched current values of the LED lamp unit corresponding to different VF-values are stored in the VF-value performance data proofreading database; when no current value corresponding to the detected VF-value is searched in the VF-value performance data proofreading database, then calculating the average value of the current values corresponding to the two VF-values adjacent to the detected VF-value in the database as the matched current value corresponding to the detected VF-value, wherein the detected VF-value is between the two VF-values.

Setting up a temperature performance data proofreading base and searching the current value corresponding to the detected temperature value in the temperature performance data proofreading base as the current value matched with the LED lamp unit, wherein the matched current values of the LED lamp unit corresponding to different temperature values are stored in the stated temperature performance data proofreading base; when no current value corresponding to the detected temperature value is searched in the temperature value performance data proofreading base, and calculating the average value of the current values corresponding to the two temperature values adjacent to the detected temperature value in the database as the matched current value corresponding to the detected temperature value, wherein the detected temperature value is between the two temperature values.

The disclosed embodiments are only preferred embodiments of the invention and the scope of the claims of the invention shall not be limited hereby. Therefore, equivalent changes made according to the claims in the invention shall still be covered in the invention.

What is claimed is:

1. An LED actuating device, comprising an LED actuating module, said LED actuating module comprising a microprogrammed control unit (MCU), an actuator, a VF-value detection module for detecting the forward operating voltage value, a PN-junction temperature acquisition module and an LED lamp unit, wherein the MCU determines the current value matched with the LED lamp unit according to the forward operating voltage value detected by the forward operating voltage value detection module and the temperature value detected by the PN-junction temperature acquisition module and then according to the current value, determines the width of the PWM pulse output to the actuator so as to actuate the LED lamp unit to operate at the matched value by the actuator; wherein the MCU comprises a performance data proofreading base of the forward operating voltage value; the MCU searches the current value corresponding to the detected forward operating voltage value in the performance data proofreading base of the forward operating voltage value and the current value is matched with the LED lamp unit; wherein when no current value corresponding to the detected forward operating voltage value in the performance data proofreading base is searched, the MCU calculates the average value of the current values corresponding to the two forward operating voltage values adjacent to the detected forward operating voltage value in the performance data proofreading base as the current value corresponding to the detected forward operating voltage value, wherein the detected forward operating voltage value is between the two adjacent forward operating voltage values.

2. The device according to claim 1, wherein the MCU comprises a performance data proofreading base of the forward operating voltage value; the MCU searches the current value corresponding to the detected forward operating voltage value in the performance data proofreading base of the forward operating voltage value and the current value is matched with the LED lamp unit.

3. The device according to claim 2, wherein when no current value corresponding to the detected forward operating voltage value in the performance data proofreading base is searched, the MCU calculates the average value of the current values corresponding to the two forward operating voltage values adjacent to the detected forward operating voltage value in the performance data proofreading base as the current value corresponding to the detected forward operating voltage value, wherein the detected forward operating voltage value is between the two adjacent forward operating voltage values.

4. The device according to claim 1, wherein the MCU comprises a temperature value performance data proofreading base in which the MCU searches the current value corresponding to the detected temperature value as the current value matched with the LED lamp unit.

5. The device according to claim 4, wherein when no current value corresponding to the detected temperature value is found in the temperature value performance data proofreading base, the MCU calculates the average value of the current values corresponding to the two temperature values adjacent to the detected temperature value in the performance data proofreading base as the current value corresponding to the detected temperature value, wherein the detected temperature value is between the two adjacent temperature values.

6. The device according to claim 1, further comprising a lightning and surge prevention module connected to a power supply terminal for eliminating the impact of lightning stroke or surge voltage, an EMI filter connected to the lightning and surge prevention module for preventing high-frequency interference from being transmitted back to a power line, a bridge rectifier module connected to the EMI filter for converting AC power to DC power, a power-factor correction module connected to the bridge rectifier module for increasing the power factor.

7. The device according to claim 1, wherein when the PN-junction temperature value acquired by the PN-junction temperature acquisition module exceeds the operating environment temperature (topm), then the MCU stops actuating the LED lamp unit.

8. An LED actuating device, comprising an LED actuating module, said LED actuating module comprising a micro-programmed control unit (MCU), an actuator, a VF-value detection module for detecting the forward operating voltage value, a PN-junction temperature acquisition module and an LED lamp unit, wherein the MCU determines the current value matched with the LED lamp unit according to the forward operating voltage value detected by the forward operating voltage value detection module and the temperature value detected by the PN-junction temperature acquisition module and then according to the current value, determines the width of the PWM pulse output to the actuator so as to actuate the LED lamp unit to operate at the matched value by the actuator; wherein the actuator comprises an LLC resonant half-bridge actuator, a half-bridge circuit consisting of two MOS tubes, an isolation transformer and a schottky diode rectifier circuit; the PWM pulse output by the MCU is sent to the LLC resonant half-bridge actuator via an opto-coupler, the LLC resonant half-bridge actuator actuates the half-bridge circuit to be on/off, the output of the half-bridge circuit bypasses the isolation transformer, and then is output to the schottky diode rectifier circuit, and then the schottky diode rectifier circuit outputs a stable DC current to supply the LED lamp unit.

9. The device according to claim 8, further comprising a current acquisition module, preferably, wherein the acquisition module acquires the value of the current passing through the LED lamp unit, and then the MCU adjusts the PWM pulse width based on the differences between the acquired current value and the matched current value.

10. An LED actuating device, comprising an LED actuating module, said LED actuating module comprising a micro-programmed control unit (MCU), an actuator, a VF-value detection module for detecting the forward operating voltage value, a PN-junction temperature acquisition module and an LED lamp unit, wherein the MCU determines the current value matched with the LED lamp unit according to the forward operating voltage value detected by the forward operating voltage value detection module and the temperature value detected by the PN-junction temperature acquisition module and then according to the current value, determines the width of the PWM pulse output to the actuator so as to actuate the LED lamp unit to operate at the matched value by the actuator; wherein the MCU comprises a temperature value performance data proofreading base in which the MCU searches the current value corresponding to the detected temperature value as the current value matched with the LED lamp unit; wherein when no current value corresponding to the detected temperature value is found in the temperature value performance data proofreading base, the MCU calculates the average value of the current values corresponding to the two temperature values adjacent to the detected temperature value in the performance data proofreading base as the current value corresponding to the detected temperature value, wherein the detected temperature value is between the two adjacent temperature values.

* * * * *